US008402991B2

(12) United States Patent
Wu

(10) Patent No.: US 8,402,991 B2
(45) Date of Patent: Mar. 26, 2013

(54) OUTLET VALVE FOR A FROST-PREVENTING FAUCET

(76) Inventor: Hung-Neng Wu, Lugang Township, Changhua County (TW)

( * ) Notice: Subject to any disclaimer, the term of this patent is extended or adjusted under 35 U.S.C. 154(b) by 370 days.

(21) Appl. No.: 12/898,854

(22) Filed: Oct. 6, 2010

(65) Prior Publication Data

US 2012/0085427 A1 Apr. 12, 2012

(51) Int. Cl.
*E03B 9/02* (2006.01)

(52) U.S. Cl. ..... 137/301; 137/454.6; 137/614.2

(58) Field of Classification Search ..... 137/301, 137/59, 454.5, 454.6, 614.2, 360, 272
See application file for complete search history.

(56) References Cited

U.S. PATENT DOCUMENTS

| | | | | |
|---|---|---|---|---|
| 6,880,573 | B2 * | 4/2005 | Berkman et al. | 137/614.2 |
| 7,140,390 | B2 * | 11/2006 | Berkman et al. | 137/614.2 |
| 7,383,858 | B2 * | 6/2008 | Hsueh | 137/614.2 |
| 7,549,444 | B2 * | 6/2009 | Li et al. | 137/614.2 |
| 7,686,028 | B2 * | 3/2010 | Wu | 137/59 |
| 8,079,382 | B2 * | 12/2011 | Wu | 137/454.5 |
| 2007/0018130 | A1 * | 1/2007 | Wu | 251/208 |

* cited by examiner

*Primary Examiner* — Kevin Lee
(74) *Attorney, Agent, or Firm* — Jackson IPG PLLC

(57) ABSTRACT

An improved outlet valve for a frost-preventing faucet substantially employs an axial slot defined at a central top inside the inlet passage for being inserted by an elastic element and an axial post. A first stop ring is disposed around the stop valve. The first stop ring and the stop valve are inserted into a limiting slot of a hollow stop sleeve disposed under the stop valve. A second stop ring disposed around the stop sleeve is inserted into a lower section of an inner wall of the inlet passage. A bottom of the second stop ring is disposed above a top of the top porcelain. Cooperating the subject improved configuration with the top porcelain allows the water to be supplied upward since outlet gates of the bottom porcelain and the top porcelain stay abreast without a blockage. When a water pressure is larger than a rebounding force of the elastic element, the stop valve upwardly compresses the elastic element. Thereby, the water travels through the inlet passage disposed at the middle section of the plug and enters into an outlet hole at the top end of the tubular receiving valve seat. The water is further upwardly guided into a supplying pipe of the faucet. When the water pressure is smaller than the rebounding force of the elastic element, the elastic element compresses the stop valve. Thereby, an axial post of the stop valve is downwardly inserted into the limiting slot of the stop sleeve for impeding the water flow, so that the porcelain valve unit is prevented from freezing, and the water pressure is capable of controlling a feeding of the water flow.

1 Claim, 5 Drawing Sheets

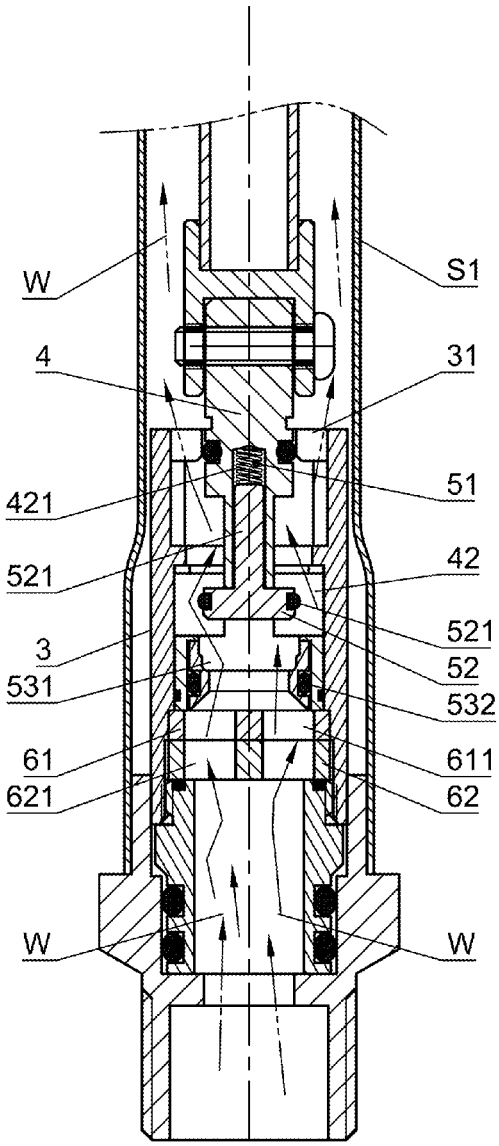
Fig. 4-B
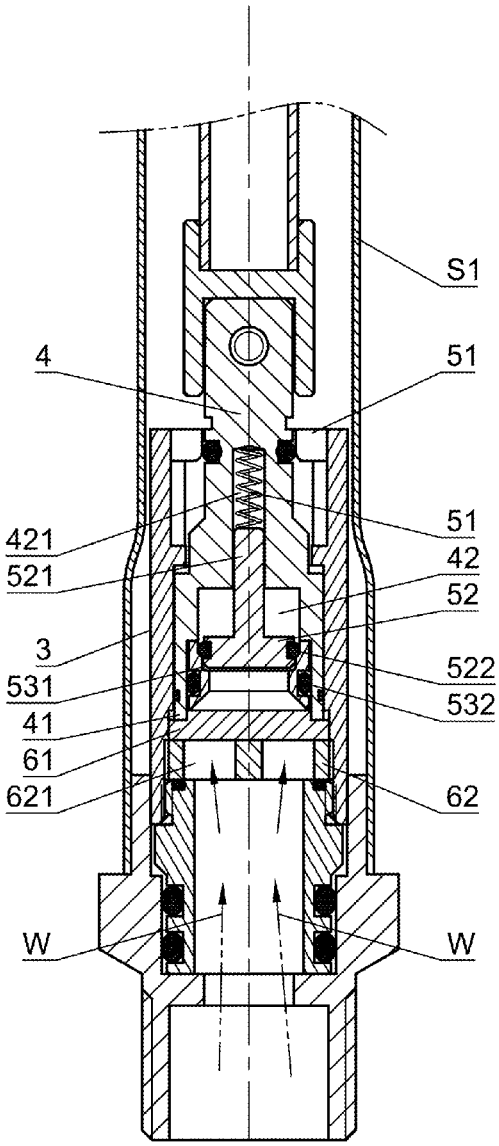
Fig. 4-A

OUTLET VALVE FOR A FROST-PREVENTING FAUCET

BACKGROUND OF THE INVENTION

1. Field of the Invention

The present invention relates to an improved outlet valve for a frost-preventing faucet that utilizes an elastic element, a stop valve and a stop sleeve disposed between an inlet passage and a porcelain unit defined in a plug to control the flow state of the supplied water along with the water pressure; thereby, the porcelain unit could be prevented from freezing.

2. Description of the Related Art

The existing frost-preventing faucet on the outside ground is mainly installed for users to either draw or sprinkle water conveniently. The conventional frost-preventing faucet S (as shown in FIG. 1) comprises a vertical water supplying pipe S1. A controlling axial seat 21 is mounted on a top portion of the water supplying pipe S1, and a downward connector 22 is connected to a bottom portion of the water supplying pipe S1. Whereby, a top end of a columnar water controlling plug 24 disposed at a bottom end of the connector is superimposed in a middle section of an axial hole 231 of a top side of a tubular receiving valve seat 23. Thereby, a parallel state between outlet gates of a top porcelain 251 and a bottom porcelain 252 of a porcelain inlet valve 25 with dual sheets disposed under the plug preferably controls the water flow. Wherein, two symmetrical quarter-circle outlet holes 2521 are formed on the bottom porcelain 252 of the porcelain inlet valve 25 along with a 90-degree angle. At a central bottom of the water controlling plug 24, an inlet passage 242 is upwardly defined into a middle section thereof. An outlet passage 243 is laterally communicated at two sides of the inlet passage 242. Herein, the butterfly-shaped top porcelain 251 with two symmetrical indentations for serving as the outlet gates is actually designed by an approximate disc. Subsequently, when the outlet holes 2521 on the bottom porcelain 252 are not impeded by the top porcelain 251, the downward supplied water would be provided from the outlet holes 2511 along with a folding-state. Thence, the supplied water further goes upward into the inlet passage 242 at the middle section of the plug 24, passes through the outlet passage 243 that is laterally communicatable, and travels through small holes 232 that are distributed around the axial hole 231 on the top side of the tubular receiving valve seat 23. Consequently, the supplied water is provided by being upwardly guided into the water supplying pipe S1 of the faucet S.

Such frost-preventing faucet merely employs the top porcelain 251 and the bottom porcelain 252 to control the water flow. Nonetheless, redundant mist easily leaks out of interstices of the structure. Aforementioned leaking problem is especially occurred in the Frigid Zone or the area that is easily iced up in winter in view of the low temperature. As a result, while the redundant water in the outlet holes 2511 is iced up, the water supplying system is thence paralyzed. The situation could be worse while the frozen water is spread on the inner wall of the water supplying pipe S1. Obviously, inconvenience for users and wastage of water are resulted. The disadvantages need to be solved.

SUMMARY OF THE INVENTION

The object of the present invention is to provide an improved outlet valve for a frost-preventing faucet. The present invention substantially employs a central bottom of a water controlling plug defining an inlet passage extended from downward toward upward into a middle section of the plug. An outlet passage is laterally communicated at two sides of the inlet passage. Wherein, an axial slot is defined at a central top inside the inlet passage for being inserted by an elastic element and an axial post. A first stop ring is disposed around the stop valve. The stop valve is inserted into a limiting slot of a hollow stop sleeve disposed under the stop valve. A second stop ring disposed around the stop sleeve is inserted into a lower section of an inner wall of the inlet passage. A bottom of the second stop ring is disposed above a top of the top porcelain disc. Cooperating the improved outlet valve with a porcelain valve unit with the top porcelain disc allows the water to be supplied upward. When the water pressure is larger than a rebounding force of the elastic element, the stop valve upwardly compresses the elastic element. Thereby, the water travels through the inlet passage disposed at the middle section of the plug and enters into an outlet hole at the top end of the tubular receiving valve seat. Accordingly, the water is further upwardly guided into a supplying pipe of the faucet. When the water pressure is smaller than the rebounding force of the elastic element, the elastic element compresses the stop valve. Thereby, an axial post of the stop valve is downwardly inserted into the limiting slot of the stop sleeve for impeding the water flow, so that the porcelain valve unit is prevented from freezing, and the water pressure is capable of controlling a feeding of the water flow.

BRIEF DESCRIPTION OF THE DRAWINGS

FIG. 4-A is a cross-sectional view showing the present invention;

FIG. 4-B is a cross-sectional view showing the present invention with water.

DETAILED DESCRIPTION OF THE PREFERRED EMBODIMENTS

Figure 1:
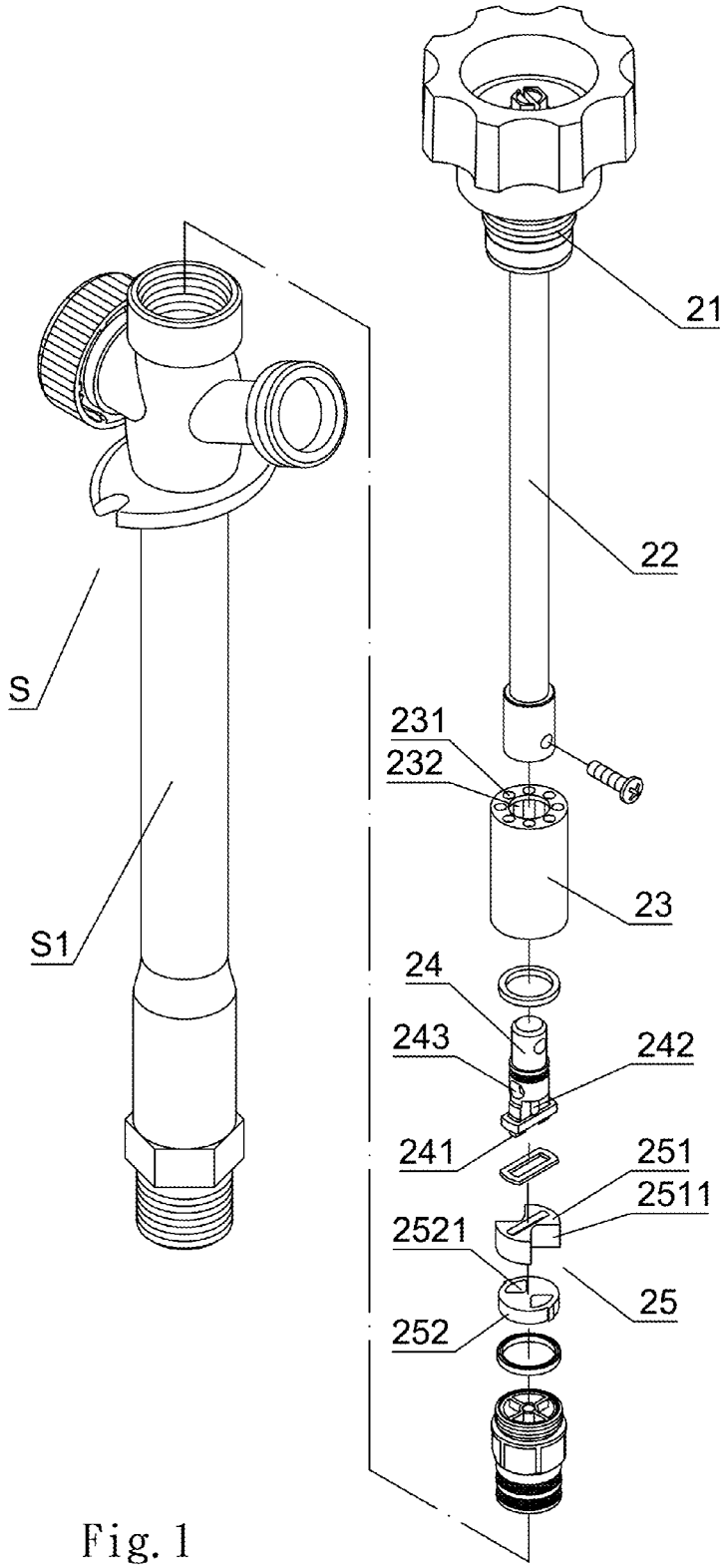
Fig. 1 Prior Art
FIG. 1 is an exploded view showing a conventional frost-preventing faucet.
Figure 2:
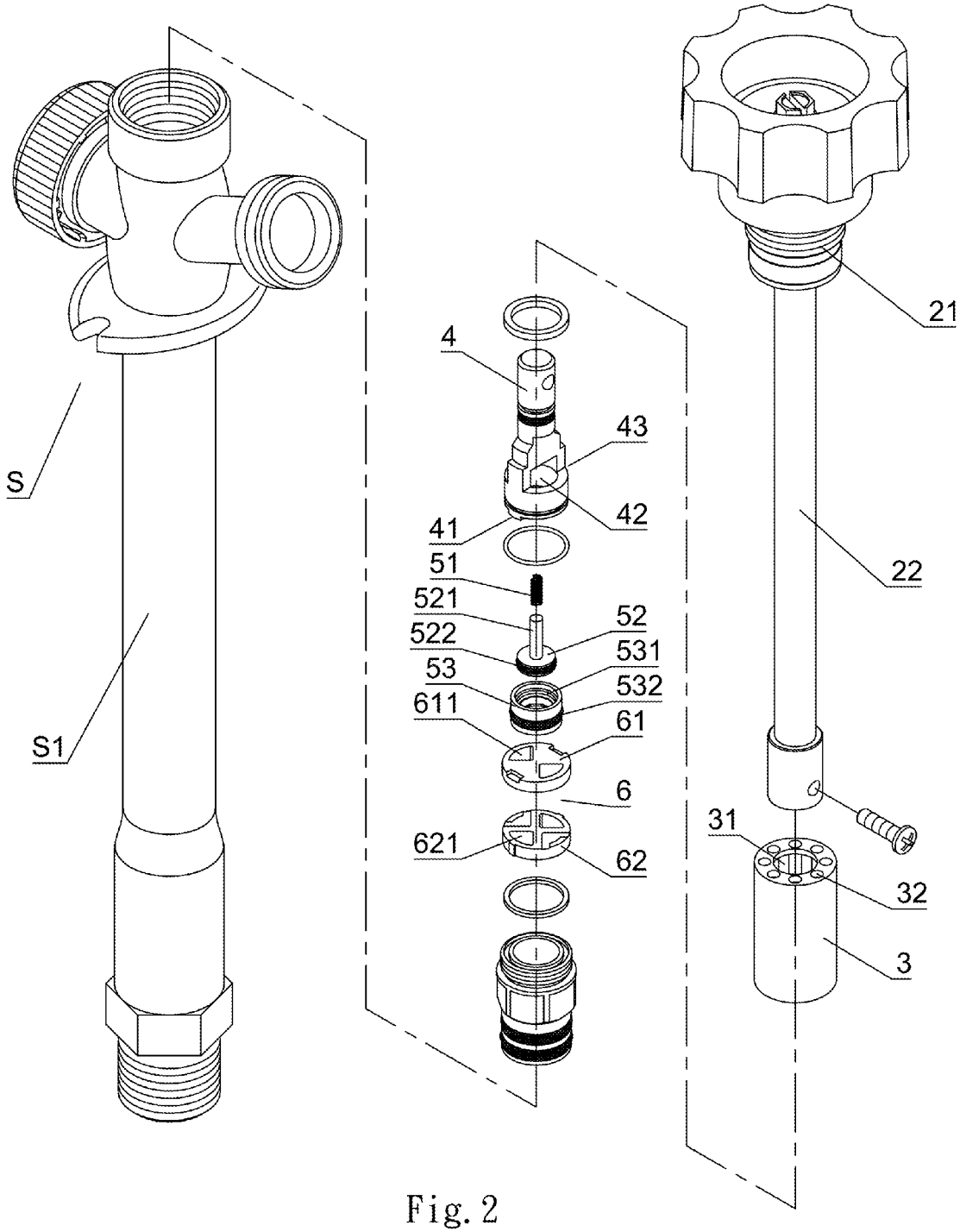
FIG. 2 is an exploded view showing the present invention.
Figure 3:
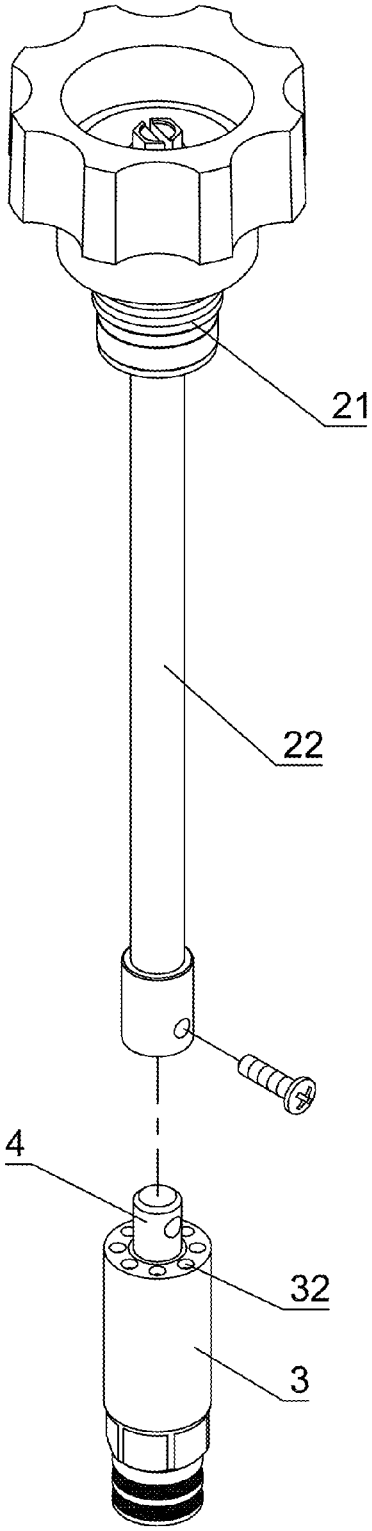
FIG. 3 is a perspective view showing the main structure of the present invention.

The present invention is shown by FIGS. 2 and 3 as follows.

An improved outlet valve for a frost-preventing faucet comprises a tubular receiving valve seat 3 with an open lower end, and a columnar water controlling plug 4 whose bottom end includes a protrudent portion 41. The protrudent portion 41 of the columnar water controlling plug 4 is embedded into two sides of a top face of a butterfly-shaped top porcelain disc 61 disposed under the plug, thereby allowing a turning adjustment of aiming an outlet gate 611 of the top porcelain disc 61 at an outlet gate 621 of a bottom porcelain disc 62. A top end of the columnar water controlling plug 4 is disposed within an axial hole 31 at a central top of the receiving valve seat 3. A central bottom of the water controlling plug 4 defines an inlet passage 42 extended from downward toward upward into a middle section of the plug 4. An outlet passage 43 is laterally communicated at two sides of the inlet passage.

Wherein, an axial slot 421 is defined at a central top inside the inlet passage 42 of the water controlling plug 4. The axial slot 421 is inserted by an elastic element 51 and an axial post 521 disposed at one end of a stop valve 52 for allowing an axial and restrictive motion. A first stop ring 522 is disposed around the stop valve 52. Inserting the first stop ring 522 as well as the stop valve 52 into a limiting slot 531 of a hollow stop sleeve 53 disposed under the stop valve 522 controls the water flow W. A second stop ring 532 disposed around the stop sleeve 53 is inserted into a lower section of an inner wall of the inlet passage 42. A bottom of the second stop ring 532 is disposed above a top of the top porcelain disc 61. By means of aforementioned structure, a porcelain unit 6 could be prevented from freezing and the water pressure is capable of controlling a feeding of the water flow.

Figure 5:
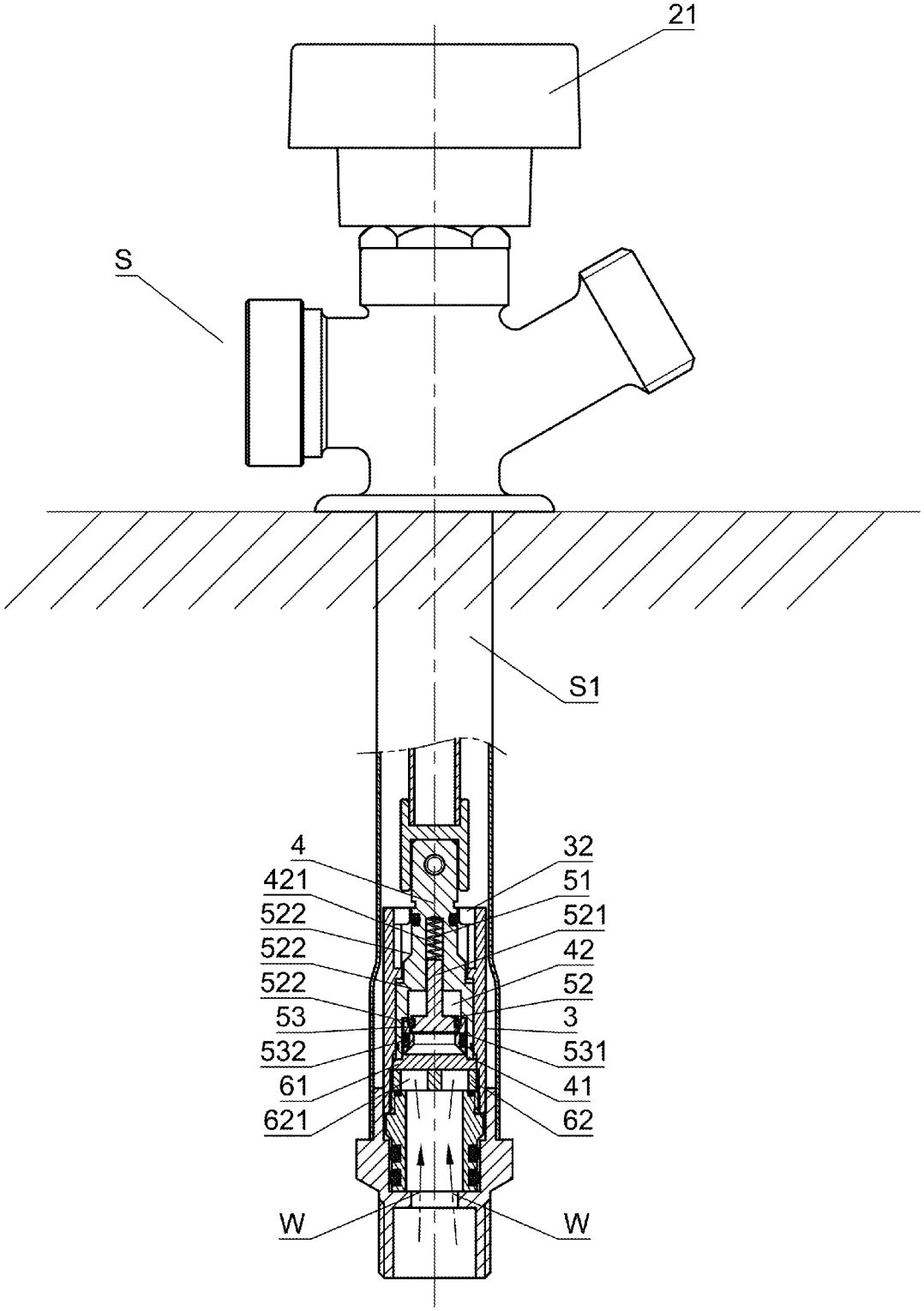
FIG. 5 is a cross-sectional view showing the present invention installed on the ground.

Referring to FIGS. 4-A to 4-B and FIG. 5, the outlet gates 611, 621 of the bottom porcelain disc 62 and the top porcelain disc 61 of the porcelain unit 6 are arranged stay abreast without blocking, so that the water W is supplied upward since the outlet gates are opened. Thereby, the upward water compresses the bottom side of the stop valve 52. When the water pressure is larger than a rebounding force of the elastic element 51, the axial post 521 of the stop valve 52 upwardly compresses the elastic element 51. Thereby, the water W travels through the inlet passage 42 disposed at the middle section of the plug 4, passes through the outlet passage 43 that is laterally disposed, and enters into outlet holes 32 distributed around the axial hole 31 at the top end of the tubular receiving valve seat 3. Accordingly, the water is further upwardly guided into a supplying pipe S1 of the faucet S. In contrast, when the water pressure is smaller than the rebounding force of the elastic element 51, the elastic element 51 compresses the axial post 521 of the stop valve 52. Thereby, the axial post 521 of the stop valve 52 is downwardly inserted into the limiting slot 531 of the stop sleeve 53 for impeding the water flow W. The water flow of such vertical water supplying pipe is adjusted by the water pressure controlling the stop valve 52. As a result, the redundant water distributed on the outlet gate 611 is not frozen, so that users are able to conveniently draw the needed water.

Accordingly, the present invention provides advantages that the porcelain valve unit 6 is prevented from freezing, and the water pressure is capable of controlling a feeding of the water flow.

I claim:

1. An outlet valve for a frost-preventing faucet comprising a tubular receiving valve seat with an open lower end and a columnar water controlling plug whose bottom end includes a protrudent portion; said columnar water controlling plug being embedded into two sides of a top face of a butterfly-shaped top porcelain disc disposed under said plug, thereby allowing a turning adjustment of aiming an outlet gate of said top porcelain disc at an outlet gate of a bottom porcelain disc; a top end of said columnar water controlling plug being disposed within an axial hole at a central top of said receiving valve seat; a central bottom of said water controlling plug defining an inlet passage extended from downward toward upward into a middle section of said plug; an outlet passage being laterally communicated at two sides of said inlet passage; wherein, an axial slot is defined at a central top inside said inlet passage; said axial slot receiving an insertion of an elastic element and an axial post disposed at one end of a stop valve for allowing an axial and restrictive motion; a first stop ring being disposed around said stop valve; said stop valve being inserted into a limiting slot of a hollow stop sleeve disposed under said stop valve to control water flow; a second stop ring being disposed around said stop sleeve and inserted into a lower section of an inner wall of said inlet passage; a bottom of said second stop ring being disposed above a top of said top porcelain disc; cooperating said outlet valve with a porcelain valve unit with said top porcelain disc allows feeding water upward when said outlet gates of said bottom porcelain disc and said top porcelain disc stay abreast without blocking; when a water pressure is larger than a rebounding force of said elastic element, said stop valve upwardly compresses said elastic element, leading to said water traveling through said inlet passage disposed at said middle section of said plug, passing through said outlet passage that is laterally communicated, entering into an outlet hole at a top end of said tubular receiving valve seat, and thence upwardly going into a supplying pipe of said faucet; when said water pressure is smaller than said rebounding force of said elastic element, said elastic element compresses said stop valve to make said stop valve downwardly inserted into said limiting slot of said stop sleeve for impeding water flow, so that said porcelain valve unit is prevented from freezing, and said water pressure is capable of controlling a feeding of said water flow.

* * * * *